US007199526B2

(12) United States Patent
Liu et al.

(10) Patent No.: US 7,199,526 B2
(45) Date of Patent: Apr. 3, 2007

(54) ELECTRONIC BALLAST

(75) Inventors: Chenyang Liu, Taoyuan Hsien (TW); Xiaoju Hu, Taoyuan Hsien (TW); Yuanyuan Zhong, Taoyuan Hsien (TW); Jianping Ying, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 173 days.

(21) Appl. No.: 11/124,012

(22) Filed: May 6, 2005

(65) Prior Publication Data

US 2006/0250094 A1 Nov. 9, 2006

(51) Int. Cl.
*H05B 37/00* (2006.01)

(52) U.S. Cl. ..... 315/105; 315/106; 315/107

(58) Field of Classification Search ..... 315/105, 315/106, 107

See application file for complete search history.

(56) References Cited

U.S. PATENT DOCUMENTS 4,438,370 A * 3/1984 Allington ..... 315/106
6,114,810 A * 9/2000 Foo ..... 315/105

FOREIGN PATENT DOCUMENTS

CN 1400852 3/2003

* cited by examiner

*Primary Examiner*—David Vu
(74) *Attorney, Agent, or Firm*—J.C. Patents

(57) ABSTRACT

An electronic ballast capable of extending life of the fluorescent lamp is disclosed. The electronic ballast according to the present invention comprises a DC/AC converter, a fluorescent lamp, a transformer, a preheating transformer and an AC switch. Wherein, the AC switch is turned off during a preheating period of time for the fluorescent lamp. Due to adoption of a preheating transformer in the secondary side and an AC switch for the electronic ballast according to the present invention, the voltage drop across the fluorescent lamp can be reduced during the preheating period of time, and accordingly no glow current would appear. Therefore, life of the electronic ballast can be effectively extended.

11 Claims, 6 Drawing Sheets

ELECTRONIC BALLAST

BACKGROUND OF THE INVENTION

1. Field of Invention

The present invention relates to an electronic ballast. More particularly, the present invention relates to an electronic ballast capable of extending life of the fluorescent lamp.

2. Description of Related Art

A fluorescent lamp is an evacuated glass tube with a small amount of mercury in the tube. The tube is lined with an adherent layer of a mixture of phosphors. Some of the mercury vaporized at low pressure within the tube and a filament or cathode in each end of the tube is heated to emit electrons into the tube, ionizing the gas. A high voltage between the filaments causes the mercury ions to conduct current, producing a glow discharge that emits ultraviolet light. The ultraviolet light is absorbed by the phosphors and re-emitted as visible light.

In general, the fluorescent lamp is driven by an electronic ballast. Referring to FIG. 1, a circuit diagram schematically showing an electronic ballast in the prior art. The circuit of electronic ballast in the prior art includes a main circuit and a preheating circuit. It is required that a preheating is applied to vaporize the mercury inside the lamp before the ignition of the fluorescent lamp. Referring to FIG. 1 again, the secondary side of the transformer L3 includes a winding L3D, a winding L3E, and a winding L3F. When the primary side of the transformer L3 starts to receive an alternative current, windings L3D, L3E and L3F induce a voltage and a current simultaneously. And the three windings are provided for applying a preheating on the filaments of the fluorescent lamp.

FIG. 1 is a circuit diagram schematically showing an electronic ballast used to drive the fluorescent lamp in the prior art. However, this electronic ballast in the prior art suffers one problem as described below. Referring to FIG. 1, when the electronic ballast drives the lamp after completion of the preheating through windings L3D, L3E, and L3F, there is still a current, i.e. a glow current, flowing through the filaments of the fluorescent lamp. This glow current continuously heats the filaments of the lamp, and therefore leads to damage of the lamp life.

To solve the previously-mentioned flaw of electronic ballast for driving the fluorescent lamp in the prior art of FIG. 1, one circuitry of the lamp (published in the patent CN. 1400852A) was proposed. As shown, FIG. 2 is a circuit diagram schematically showing another electronic ballast in the prior art. Referring to FIG. 2, a transformer T2 is used for preheating the lamp. When the circuit activates, an alternative current received by the primary side T22 of the transformer T2 is rectified through a diode D1. Also, the rectified voltage is divided through resistors R1 and R2 and outputted to a capacitor C2. The capacitor C2 and resistors R1 and R2 are specifically designed for providing a preheating period of time required for the lamp. When the capacitor C2 is charged to a predetermined voltage value, i.e. completion of the preheating, the SCR is triggered so that the transformer T2 is turned off. Therefore, due to the cut-off state of the transformer T2, no glow current flowing through filaments of the lamp appears. By doing so, flaws of the electronic ballast in FIG. 1 can be resolved.

Yet, there is still a flaw of the electronic ballast mentioned above. Usually, a self-excitement resonant circuit is designed to drive the transistors Q1 and Q2 in the circuit for the purpose of cost-effective consideration. But with usage of the transformer T2 it is quite difficult and complicated for the designing of the circuit to drive the transistors Q1 and Q2 that could meet the requirements for the lamp during period of the preheating and the steady state subsequently.

SUMMARY OF THE INVENTION

In view of this, the present invention is to provide an electronic ballast capable of extending life of a fluorescent lamp.

In view of this, the present invention is to provide another electronic ballast capable of extending life of a fluorescent lamp.

In view of this, the present invention is to provide a preheating method for a fluorescent lamp.

The electronic ballast according to the present invention comprises a DC/AC converter, a fluorescent lamp, a transformer, a preheating transformer and an AC switch. The transformer includes a primary-side winding and a secondary-side winding. The preheating transformer includes a first winding and a second winding. The DC/AC converter is used for receiving an input of direct current, and transforming the input of direct current into an alternative current. The fluorescent lamp includes a first filament and a second filament.

The primary-side winding of the transformer above is used for receiving the alternative current. The secondary-side winding includes a first terminal and a second terminal, wherein the first terminal is connected to one terminal of the first filament. The first winding includes a third terminal connected to one terminal of the second filament and a fourth terminal connected to the second terminal. The second winding includes a fifth terminal connected to the other terminal of the first filament and a sixth terminal connected to the first terminal. One terminal of the AC switch is connected to the third terminal and the other terminal of the AC switch is connected to the fourth terminal. Wherein, the AC switch is turned off during a preheating period of time for the fluorescent lamp.

The mentioned-above preheating transformer further comprises a third winding which includes a seventh terminal connected to the third terminal and a eighth terminal connected to the other terminal of the second filament.

The mentioned-above electronic ballast further comprises a resonant capacitor connected between the first terminal and the third terminal.

The electronic ballast according to the present invention comprises a DC/AC converter, an output device, a main transformer, a preheating transformer and a AC switch. The DC/AC converter is for receiving an input of direct current and transforming the input of direct current into an alternative current, and the output device includes an output capacitor and a lamp wherein the lamp including first and second filament. Next, the main transformer includes a primary-side winding for receiving the alternative current and a secondary-side winding for supplying power to the lamp. The preheating transformer is connected between the secondary-side winding of the main transformer and the output device, wherein the preheating transformer including a primary winding connected in series with said the output device and a secondary winding connected to the first filament and/or the second filament. Besides, the AC switch is connected in parallel with the primary winding of the preheating transformer. Wherein, the AC switch is turned off during a preheating period of time for the lamp.

The preheating method for a fluorescent lamp according to the present invention comprises the steps as follows:

providing a transformer which includes a secondary-side winding; providing a preheating transformer including a first winding and at least a second winding wherein one terminal of the first winding being connected to the secondary-side winding of the transformer; preheating the fluorescent lamp during a preheating period through a current flowing to the first winding and an induced current in the second winding, wherein the induced current responding to a current flowing through the secondary-side winding to the first winding; and providing a conducting path between two terminals of the first winding with a controllable conducting device when the preheating is completed. The preheating method for a fluorescent lamp according to the present invention can further comprises a step of reducing a voltage drop across the fluorescent lamp wherein the voltage drop is divided by using combination of the first winding and the fluorescent lamp during the preheating period of time. Besides, the preheating period of time mentioned above is determined by an AC switch.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 3:
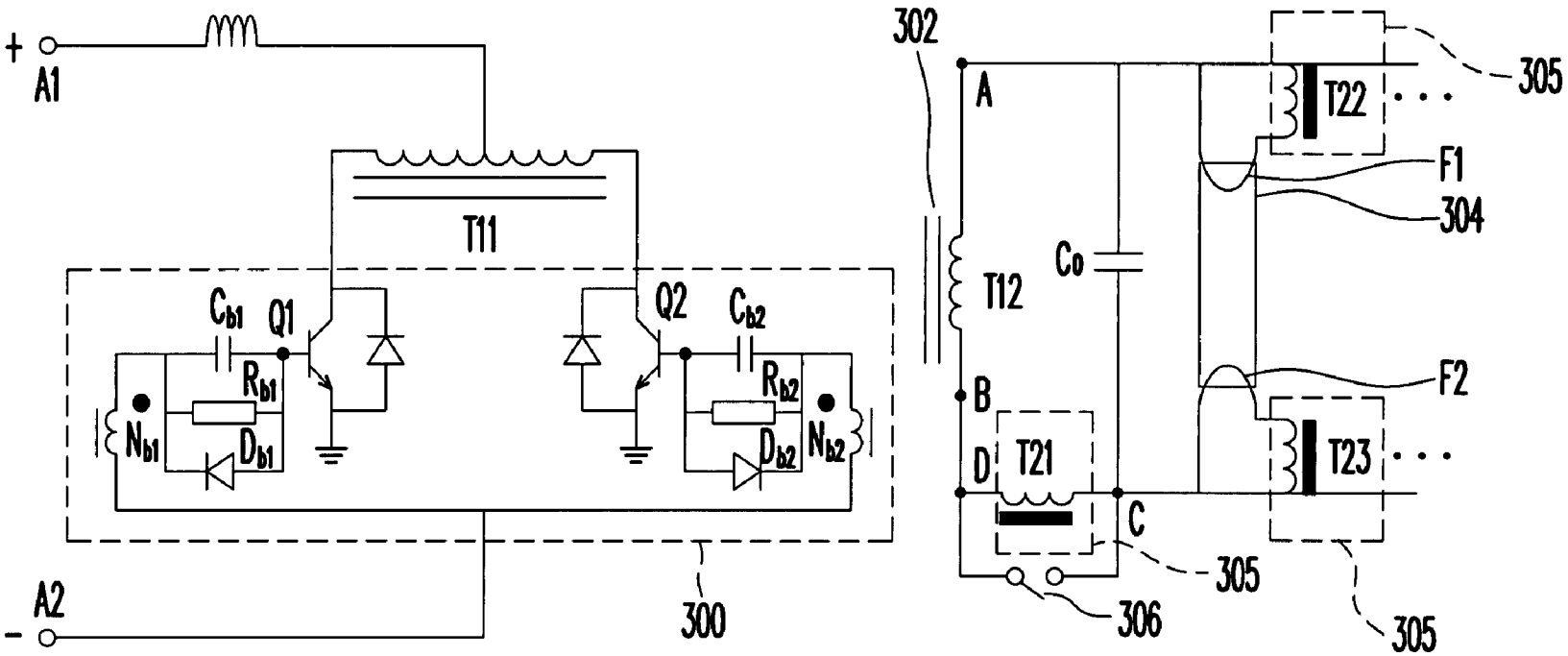
FIG. 3 is a circuit diagram schematically showing an electronic ballast according to one embodiment of the present invention.

FIG. 3 is a circuit diagram, schematically showing an electronic ballast according to one embodiment of the present invention. Referring to FIG. 3, the electronic ballast includes a DC/AC converter 300, a transformer 302, a fluorescent lamp 304, a preheating transformer 305, and an alternative-current switch 306. In the present embodiment, the DC/AC converter 300 and the transformer 302 are used for providing a self-excitement resonant alternative voltage so as to drive the fluorescent lamp 304. Many types of converters can be easily utilized by those skilled in the prior art, such as the push-pull converter, the half-bridge converter or the full-bridge converter. The push-pull converter is used in the present embodiment, and others will not be discussed herein. Also, the electronic ballast based on the present invention is suitable for driving two or more fluorescent lamps.

In FIG. 3, the fluorescent lamp 304 includes a filament F1 and a filament F2. The transformer 302 includes a primary-side winding T11 and a secondary-side winding T22, and the preheating transformer 305 includes a winding T21, a winding T22 and a winding T23. The primary-side winding T11 of the transformer 302 is used for receiving an alternative current from the DC/AC converter 300. The secondary-side winding T22 of the transformer 302 includes a terminal A electrically connected to the filament F1 and the winding T22 and a terminal B. In addition, one terminal of the winding T23 is electrically connected to the filament F2 of the fluorescent lamp 304 and the other terminal thereof is electrically connected to a terminal C. One terminal of the winding T22 is electrically connected to the terminal A and the other terminal thereof electrically connected to the filament F1. Further, one terminal of the AC switch 306 and the winding T21 is electrically connected to the terminal C and the other terminal electrically connected to a terminal D.

Figure 1:
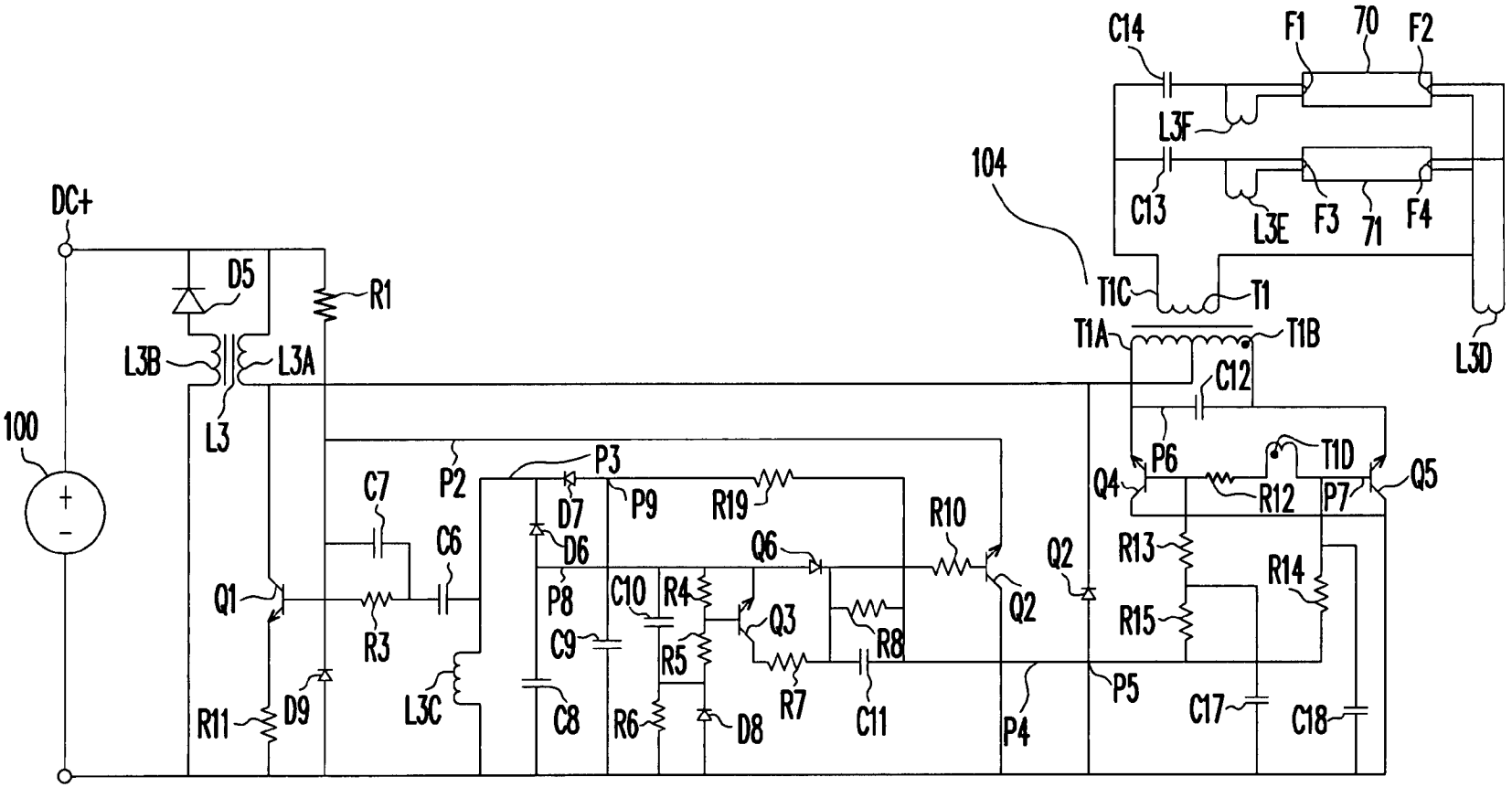
FIG. 1 (PRIOR ART)
FIG. 1 is a circuit diagram schematically showing an electronic ballast in the prior art.
Figure 2:
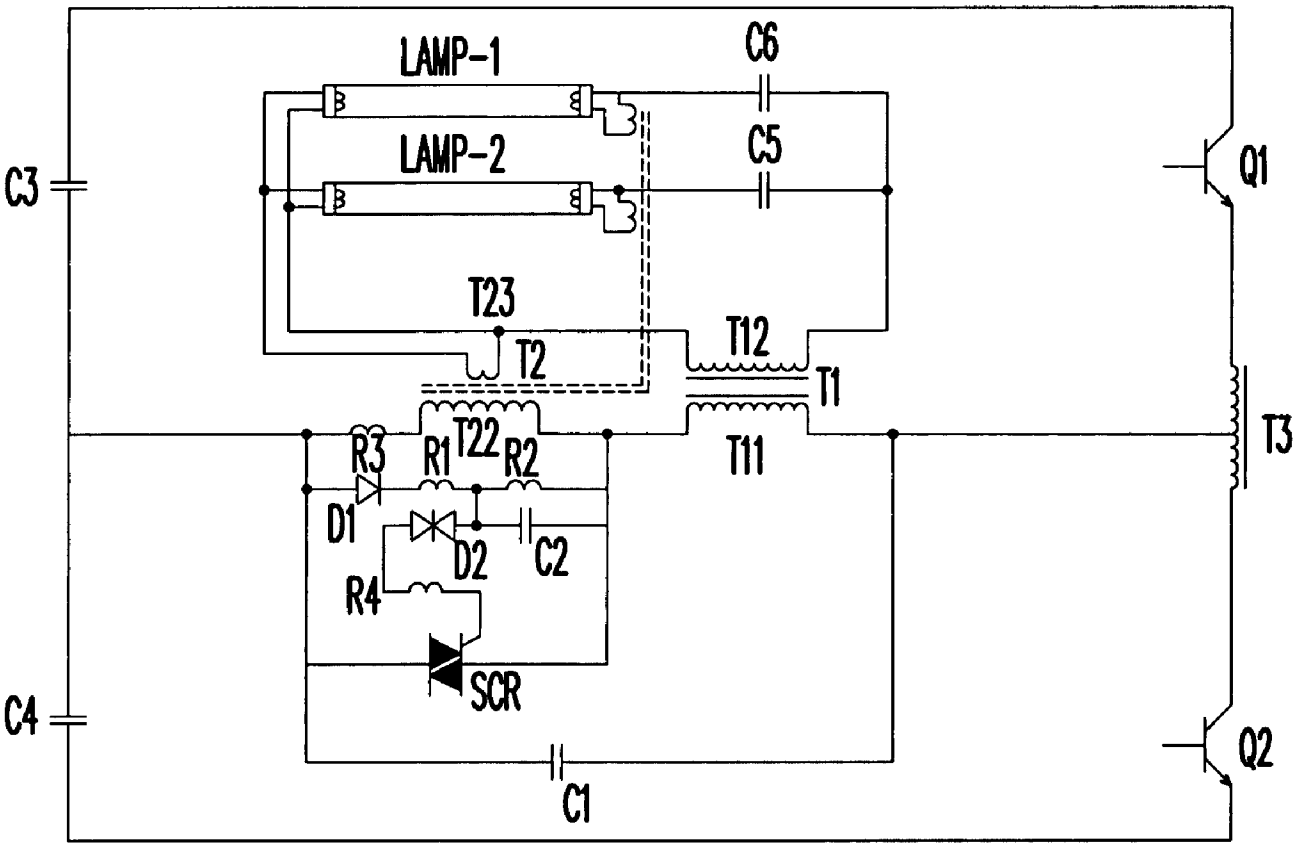
FIG. 2 (PRIOR ART)
FIG. 2 is a circuit diagram schematically showing another electronic ballast in the prior art.

Please refer to the right-hand side of the circuit, i.e. the secondary side of the transformer 302. It can seen that both the traditional electronic ballast in FIG. 1 and one embodiment of the present invention in FIG. 3 the windings T22 and T23, respectively coupled to the filaments of the fluorescent lamp for preheating, are adopted. Nevertheless, the difference between them is that the electronic ballast according to the present invention further includes an AC switch 306, which is electrically coupled in parallel with the winding T21. During the preheating period of time, the AC switch 306 is turned off. The winding T21 of the preheating transformer 305 receives a current of the secondary-side T12, and an induced current of the windings T22 and T23 appears and flows through the filaments F1 and F2. When the preheating is completed with the on-state of the AC switch 306, no current would flow trough the windings T21, T22 and T33. Consequently, no glow current flows through filaments F1 and F2 of the fluorescent lamp 304. By doing so, life of the fluorescent lamp can be effectively extended.

Refer to FIG. 3 again. When the electronic ballast is activated, input of the direct current is transformed into an alternate current by the DC/AC converter 300, and this alternative current is inputted to the primary-side winding T11 of the transformer 302. Simultaneously, an alternative current is induced by the secondary-side winding T12 of the transformer 302, and windings T22 and T23 of the preheating transformer 305, while the fluorescent lamp 304 is under the preheating and the AC switch 306 is turned off. So the preheating to excite the mercury vapor inside the lamp is applied by windings T22 and T23.

At this moment, with the additional usage of the winding T21 the voltage across the fluorescent lamp 304, i.e. the terminal A and terminal C, follows the formula below.

$$V_{AC} = \frac{Z_{C_O}}{Z_{C_O} + Z_{T21}} \times V_{AB}$$

From the above formula it can be known that the voltage across the lamp 304 is equal to the voltage across the terminal A and terminal B that is divided through impedance of the resonant capacitor Co and the winding T21. Therefore, with comparatively lower voltage across the lamp 304 before the preheating is entirely completed, life of the lamp 304 is effectively extended.

Figure 4:
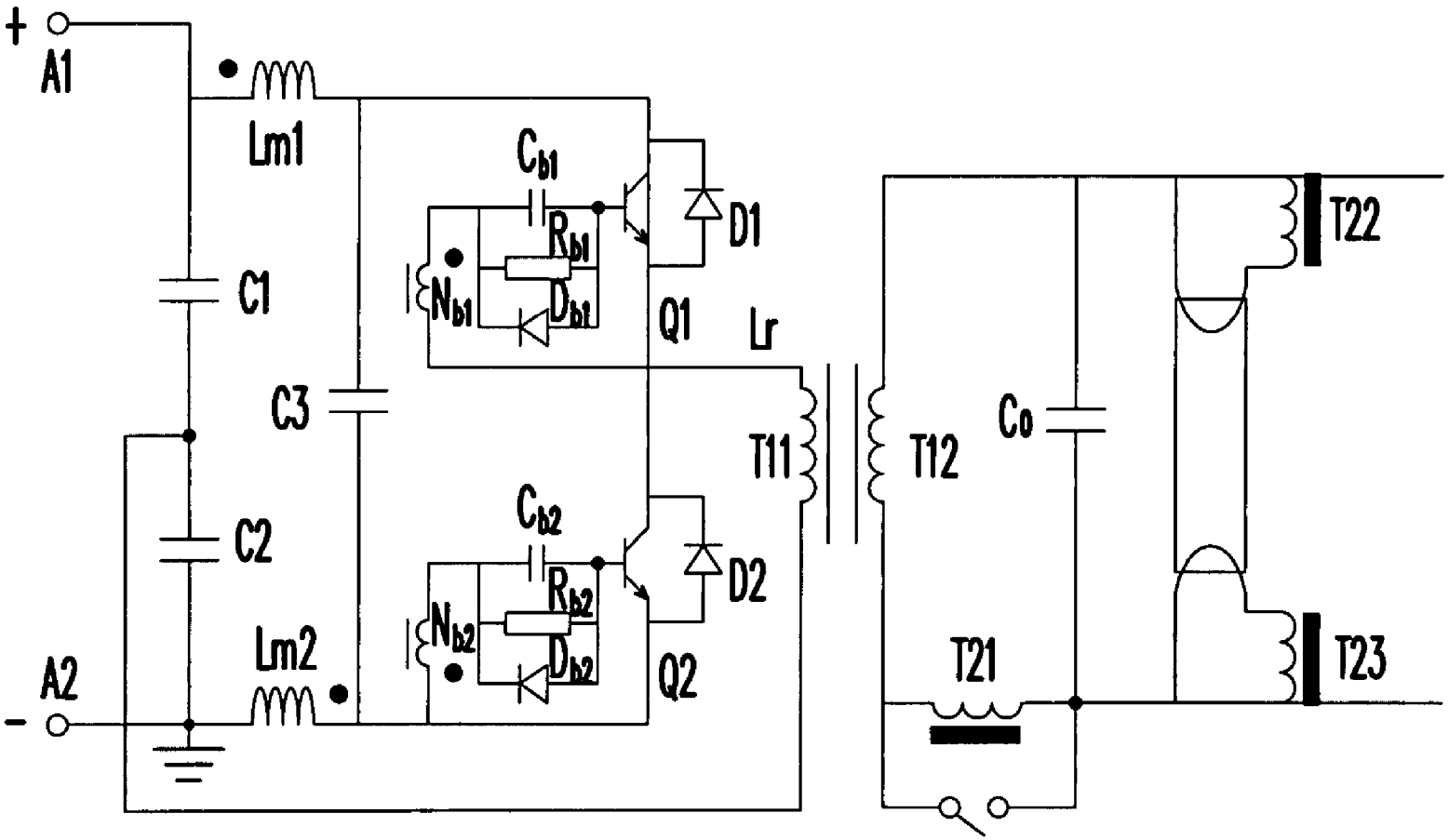
FIG. 4 is a circuit diagram schematically showing an electronic ballast according to another embodiment of the present invention.

FIG. 4 is a circuit diagram schematically showing an electronic ballast according to one another embodiment of the present invention. Since the only difference between this circuit of the electronic ballast in FIG. 4 and that in FIG. 3 is that the adoption of half-bridge converter in the DC/AC converter, with respective reminder of the circuits basing on the same ground, it will be easily understood by those skilled in the art and the related descriptions will not repeated herein.

Figure 5:
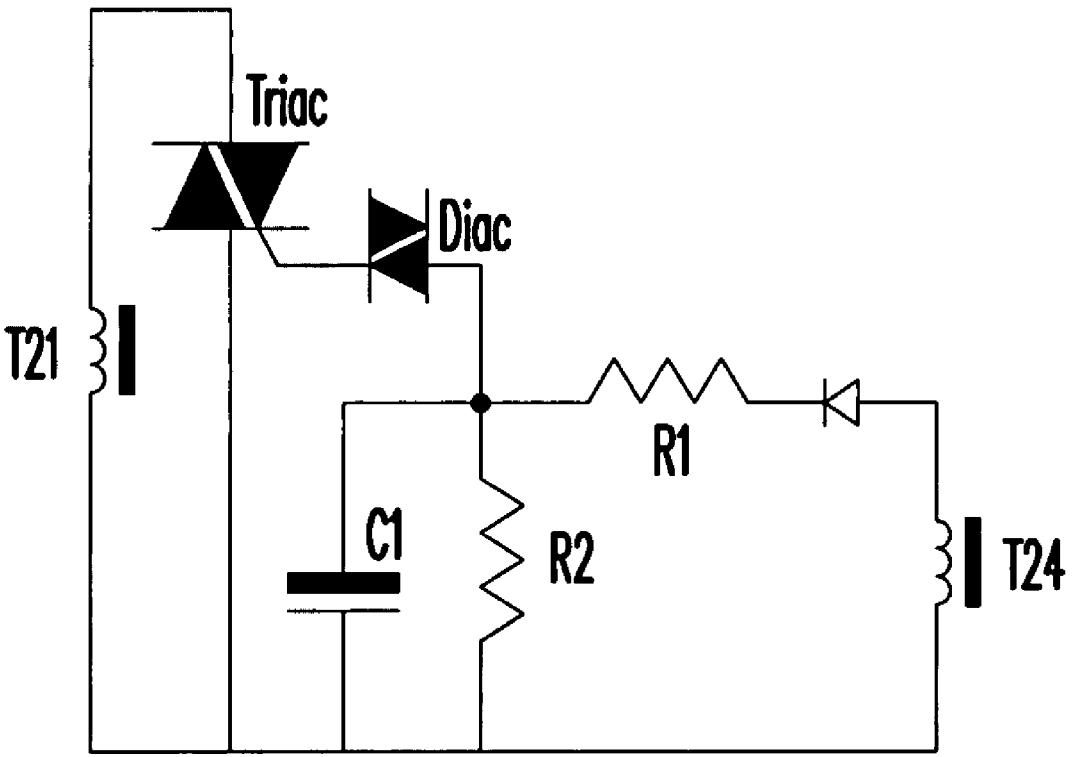
FIG. 5 is a circuit diagram schematically showing one exemplary AC switch used in the embodiments of present invention (both in FIG. 3 and FIG. 4).

FIG. 5 is a circuit diagram schematically showing one exemplary AC switch used in the embodiments of the present invention (See embodiments in FIG. 3 and FIG. 4). Refer to FIG. 3 and FIG. 4 at the same time. The AC switch 306 includes a winding T24, a diode D1, resistors R1 and R2, a capacitor C1, a Diac and a Triac. After the induced current of the winding T24 being half-wave rectified through the diode D1, and the accompanied induced voltage being divided through the resistors R1 and R2, the capacitor C1 is charged. Here, the resistors R1, R2 and the capacitor C1 are specifically designed to provide the required preheating period of time for the lamp. When the capacitor C1 is charged to a predetermined voltage value, indicating the completion of the preheating, the Diac is turned on to trigger the Triac, then turning on the AC switch 306. Thus, due to the on-state of the AC switch 306, no induced current and induced voltage of the windings T22, T23 and T24 appear.

Figure 6:
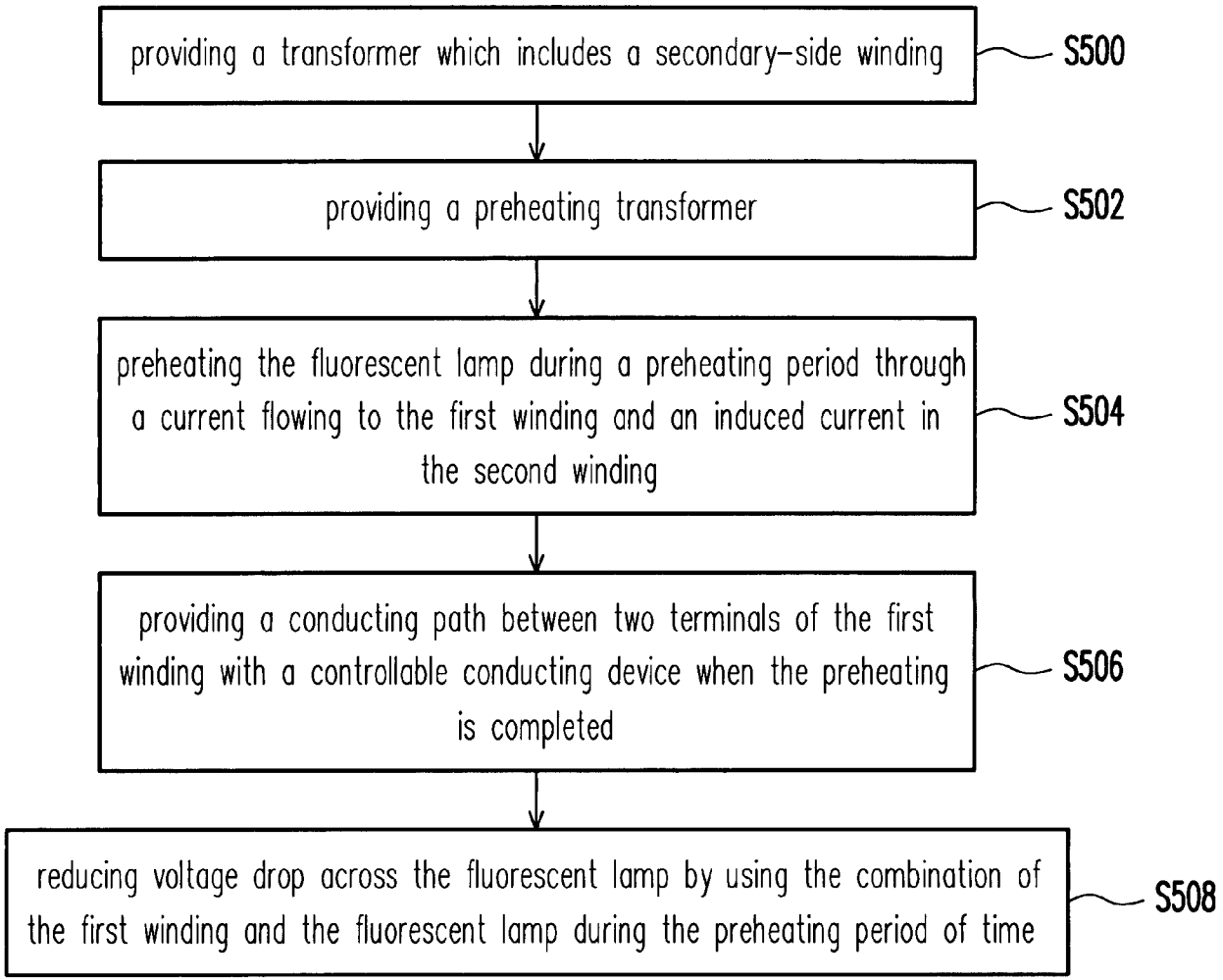
FIG. 6 is a flow chart, schematically illustrating the preheating method for a fluorescent lamp according to the present invention.

FIG. 6 is a flow chart, schematically showing the preheating method for a fluorescent lamp according to the present invention. Referring to FIG. 6, the preheating method for a fluorescent lamp comprises the steps as follows. First, a transformer including a secondary-side winding is provided in step S500. Next, in step S502 a preheating transformer is provided wherein the preheating transformer includes a first winding and at least a second winding with one terminal of the first winding being connected to the secondary-side winding of the transformer. In the preheating method for a fluorescent lamp, the preheating period of time required can be determined by utilizing a specifically designed AC switch.

Subsequently, a step S504 of preheating the fluorescent lamp during a preheating period is performed through a current flowing to the first winding and an induced current in the second winding, as shown in FIG. 6. Here, the induced current responds to the current flowing to the first winding through the secondary-side winding. And finally, a conducting path between two terminals of the first winding is supplied by a controllable conducting device when the preheating is completed. That is, step S506 is to connect both terminals of the first winding with the preheating completed. In addition, one step S508 can be further included. This step S508 is to reduce the voltage drop across the fluorescent lamp, wherein the voltage drop is divided by using combination of the first winding and the fluorescent lamp during the preheating period of time.

In a word, due to adoption of a preheating transformer in the secondary side and an AC switch in the electronic ballast according to the present invention, the voltage drop across the fluorescent lamp can be reduced during the preheating period of time, and accordingly no glow current would appear. Therefore, life of the electronic ballast can be effectively extended.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. An electronic ballast, comprising:

a DC/AC converter, for receiving an input of direct current and transforming the input of direct current into an alternative current;

a fluorescent lamp, including a first filament and a second filament;

a transformer including:

a primary-side winding for receiving the alternative current;

a secondary-side winding which includes a first terminal and a second terminal, wherein the first terminal is connected to one terminal of the first filament;

a preheating transformer including:

a first winding which includes a third terminal connected to one terminal of the second filament and a fourth terminal connected to the second terminal; and a second winding which includes a fifth terminal connected to the other terminal of the first filament and a sixth terminal connected to the first terminal; and an AC switch whose one terminal is connected to the third terminal and the other terminal of the AC switch is connected to the fourth terminal;

wherein the AC switch is turned off during a preheating period of time for the fluorescent lamp.

2. The electronic ballast as claimed in claim 1, wherein the preheating transformer further comprises a third winding which includes a seventh terminal connected to the third terminal and an eighth terminal connected to the other terminal of the second filament.

3. The electronic ballast as claimed in claim 1, further comprising a resonant capacitor connected between the first terminal and the third terminal.

4. The electronic ballast as claimed in claim 1, wherein the DC/AC converter includes a half-bridge converter.

5. The electronic ballast as claimed in claim 1, wherein the AC/DC converter includes a push-pull converter.

6. The electronic ballast as claimed in claim 1, wherein the AC/DC converter includes a fill-bridge converter.

7. The electronic ballast as claimed in claim 1, wherein the AC switch comprises a Diac, a Triac, a diode, a fourth winding, a first resistor, a second resistor, and a capacitor.

8. An electronic ballast, comprising:

a DC/AC converter, for receiving an input of direct current and transforming the input of direct current into an alternative current;

an output device including an output capacitor and a lamp, wherein the lamp including a first filament and a second filament;

a main transformer including:

a primary-side winding for receiving the alternative current; and a secondary-side winding for supplying power to the lamp;

a preheating transformer connected between the secondary-side winding of the main transformer and the output device, wherein the preheating transformer including:

a primary winding connected in series with the output device; and a secondary winding connected to the first filament and/or the second filament;

and an AC switch connected in parallel with the primary winding of the preheating transformer;

wherein, the AC switch is turned off during a preheating period of time for the lamp.

9. A preheating method for a fluorescent lamp, comprising steps of:

providing a transformer which includes a secondary-side winding;

providing a preheating transformer including a first winding and at least a second winding wherein one terminal of the first winding being connected to the secondary-side winding of the transformer;

preheating the fluorescent lamp during a preheating period through a current flowing to the first winding and an induced current in the second winding, wherein the induced current responding to a current flowing through the secondary-side winding to the first winding; and providing a conducting path between two terminals of the first winding with a controllable conducting device when the preheating is completed.

10. The preheating method for a fluorescent lamp as claimed in claim 9, further comprising a step of reducing a voltage drop across the fluorescent lamp wherein the voltage drop is divided by using combination of the first winding and the fluorescent lamp during the preheating period of time.

11. The preheating method for a fluorescent lamp as claimed in claim 9, wherein the preheating period of time is determined by an AC switch.

* * * * *